US005926914A

United States Patent [19]

Kuo

[11] Patent Number: 5,926,914

[45] Date of Patent: Jul. 27, 1999

[54] LOCKING/UNLOCKING MECHANISM FOR THE EXTENDABLE HANDLE ON A HAND-TRAILABLE LUGGAGE CASE

[75] Inventor: Chung Hsien Kuo, Taipei, Taiwan

[73] Assignee: Chaw-Khong Technology Co. Ltd., Taipei County, Taiwan

[21] Appl. No.: 09/021,895

[22] Filed: Feb. 11, 1998

[51] Int. Cl.[6] ..... A47B 95/02

[52] U.S. Cl. ..... 16/115; 280/655; 190/115

[58] Field of Search ..... 16/115; 280/655, 280/655.1, 47.371, 47.315; 190/39, 115, 18 A, 15 R, 104, 14

[56] References Cited

U.S. PATENT DOCUMENTS

| | | | |
|---|---|---|---|
| 5,322,334 | 6/1994 | Hammer | 16/115 |
| 5,499,426 | 3/1996 | Hsieh | 16/115 |
| 5,526,908 | 6/1996 | Wang | 16/115 |
| 5,630,250 | 5/1997 | Chou | 16/115 |

*Primary Examiner*—Chuck Y. Mah

*Attorney, Agent, or Firm*—Tung & Associates

[57] ABSTRACT

A locking/unlocking mechanism is provided for use on the extendable handle of a hand-trailable luggage case, which is smooth in operation and reliable for use for a long period of time. The locking/unlocking mechanism of the invention is for use on an extendable handle on a hand-trailable luggage case for the purpose of locking the extendable handle at a retracted position and allowing a user to unlock the extendable handle from the retracted and locked position so that the extendable handle can be freely extended out for use by the user. The locking/unlocking mechanism includes a casing having a receptacle; an actuating device allowing the user to unlock and release the extendable handle from the retracted position by pressing thereon; a pair of slidable devices, each being formed with a locking bolt on an outer side thereof for locking the elongated bars of the extendable handle at the retracted position and a toothed bar on an inner side thereof which is meshed to a gear. The provision of the gear meshed to the toothed bars on the slidable devices allows the locking/unlocking mechanism to operate smoothly when unlocking the elongated bars of the extendable handle from locked position.

6 Claims, 6 Drawing Sheets

LOCKING/UNLOCKING MECHANISM FOR THE EXTENDABLE HANDLE ON A HAND-TRAILABLE LUGGAGE CASE

BACKGROUND OF THE INVENTION

1. Field of the Invention

This invention relates to locking/unlocking mechanism, and more particularly, to a locking/unlocking mechanism for use on the extendable handle of a hand-trailable luggage case, which allows the user to easily unlock and draw out the extendable handle for use and also allows smooth operation of the locking/unlocking mechanism for prolong life of use.

2. Description of Related Art

A hand-trailable luggage case is widely used by travelers at airports to carry personal belongings, which is equipped with wheels and an extendable handle that allows the user to easily and effortlessly carry the luggage case by dragging it on the wheels along the ground. The extendable handle is normally retracted and locked in the luggage case and can be unlocked to be extended out for the user to drag the wheeled luggage case along the ground.

In conventional hand-trailable luggage cases, however, the locking/unlocking mechanism for the retractable handle is quite ineffective in operation, such as Wang, U.S. Pat. No. 5,526,908 discloses a Retractable Handle Assembly for a Suitcase, and Hsieh, U.S. Pat. No. 5,499,426 discloses a Retractable Handle Device for a Wheeled Suitcase which can cause the locking/unlocking mechanism inconvenient to use or cause wear to the same that would soon impair the locking/unlocking mechanism.

For simplifying the description, only taking Hsieh U.S. Pat. No. 5,499,426 for example to describe in detail with reference to FIGS. 1 and 2. FIGS. 1 and 2 are schematic side cross sectional views showing a retractable handle device at a locked and unlocked positions, respectively. As shown, the locking/unlocking mechanism of Hsieh's patent includes a push knob 71 and a pair of projecting members 82. Further, a pair of actuating members are formed beneath the push knob 71. Each of the projecting members 82 is formed with an inclined surface 823 which is functionally coupled to the actuating members of the push knob 71. Two compression spring 85 are provided between the two projecting members 82, which can urge the projecting members 82 outwards so as to lock the retractable handle in position when retracted. When the push knob 71 is pressed down by the user, it will cause the actuating members to move downwards and press on the inclined surfaces 823 of the projecting members 82, thus urging the projecting members 82 to come toward each other. When the projecting members 82 are withdrawn from the first engaging holes 900, the retractable handle will be unlocked that allows the user to freely extend it out for use.

One drawback to the foregoing locking/unlocking mechanism, however, is that the use of the knob 71 to urge against the projecting members 82 to unlock the retractable handle from the retracted position would not be reliable to use. In the event that the knob 71 is not pressing down directly on the center point but instead on a side point, the two actuating members of the knob 71 would not come into precise abutment on the respective inclined surfaces 823 of the projecting members 82 at the same time, causing the projecting members 82 to be unable to be withdrawn to unlock the retractable handle. Moreover, when the force applied by the user on the knob 71 is not evenly distributed over the surface of the knob, the locking/unlocking mechanism may not operate properly. The user may thus have difficulty in unlocking and extending out the handle.

Moreover, the conventional locking/unlocking mechanism would be easily damaged due to wear.

SUMMARY OF THE INVENTION

It is therefore an objective of the present invention to provide a locking/unlocking mechanism for the extendable handle of a hand-trailable luggage case which allows the user to conveniently extend out the handle.

It is another objective of the present invention to provide a locking/unlocking mechanism for the extendable handle of a hand-trailable luggage case, which is reliable for use for a long period of time without easily causing wear and thus damage in the inside structure of the locking/unlocking mechanism.

In accordance with the foregoing and other objectives of the present invention, a new locking/unlocking mechanism for the extendable handle of a hand-trailable luggage case is provided. The locking/unlocking mechanism of the invention is for use on an extendable handle on a hand-trailable luggage case for the purpose of locking the inside structure of the locking/unlocking mechanism.

In accordance with the foregoing and other objectives of the present invention, a new locking/unlocking mechanism for the extendable handle of a hand-trailable luggage case is provided. The locking/unlocking mechanism of the invention is for use on an extendable handle on a hand-trailable luggage case for the purpose of locking the extendable handle at a retracted position and allowing a user to unlock the extendable handle from the retracted and locked position so that the extendable handle can be freely extended out for use by the user. The extendable handle includes a pair of parallel elongated bars which are extendable from and retractable into the luggage case. The locking/unlocking mechanism of the invention includes the following constituent parts: a casing having a receptacle for enclosing the locking/unlocking mechanism therein; an actuating device allowing the user to unlock and release the extendable handle from the retracted position by pressing thereon, the actuating device including a button, a restoring spring beneath the button, and an inclined surface; a pair of slidable devices, each being formed with a locking bolt on an outer side thereof for locking the elongated bars of the extendable handle at the retracted position, an inclined surface which comes in abutment with and urged by the inclined surface on the actuating device when the button is pressed down, a toothed bar on an inner side thereof; and a restoring spring which allows the slidable devices to be restored to original position when the button is released; and a gear meshed to each toothed bar on each of the slidable devices, each toothed bar being moved along on the gear when the slidable devices are being moved inwards toward each other due to the depression of the button on the actuating device or outwards from each other due to the user releasing the button from the depressed state that causes the button to be restored up to original position by means of the restoring spring.

In conclusion, the locking/unlocking mechanism of the invention is characterized in the provision of the inclined surfaces on the bottom of the button of the actuating device and the provision of the gear meshed to the toothed bars on the slidable devices.

BRIEF DESCRIPTION OF DRAWINGS

The invention can be more fully understood by reading the following detailed description of the preferred embodiments, with reference made to the accompanying drawings, wherein.

DETAILED DESCRIPTION OF PREFERRED EMBODIMENTS

Figure 1:
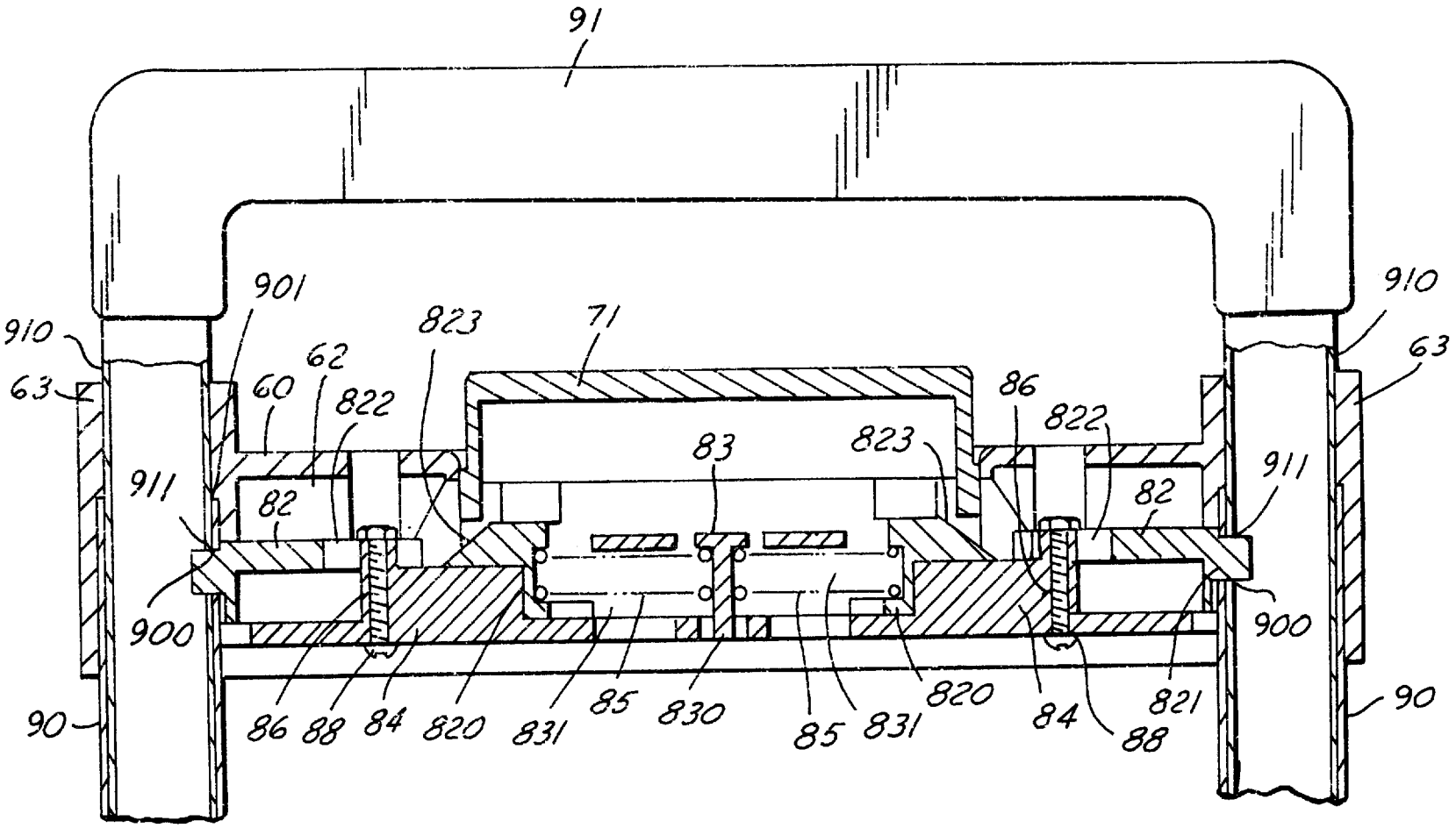
(PRIOR ART) FIG. 1
FIG. 1 is a schematic cross sectional side view of a conventional locking/unlocking mechanism for the retractable handle on a hand-trailable luggage case when the knob thereof is not pressed down.
Figure 2:
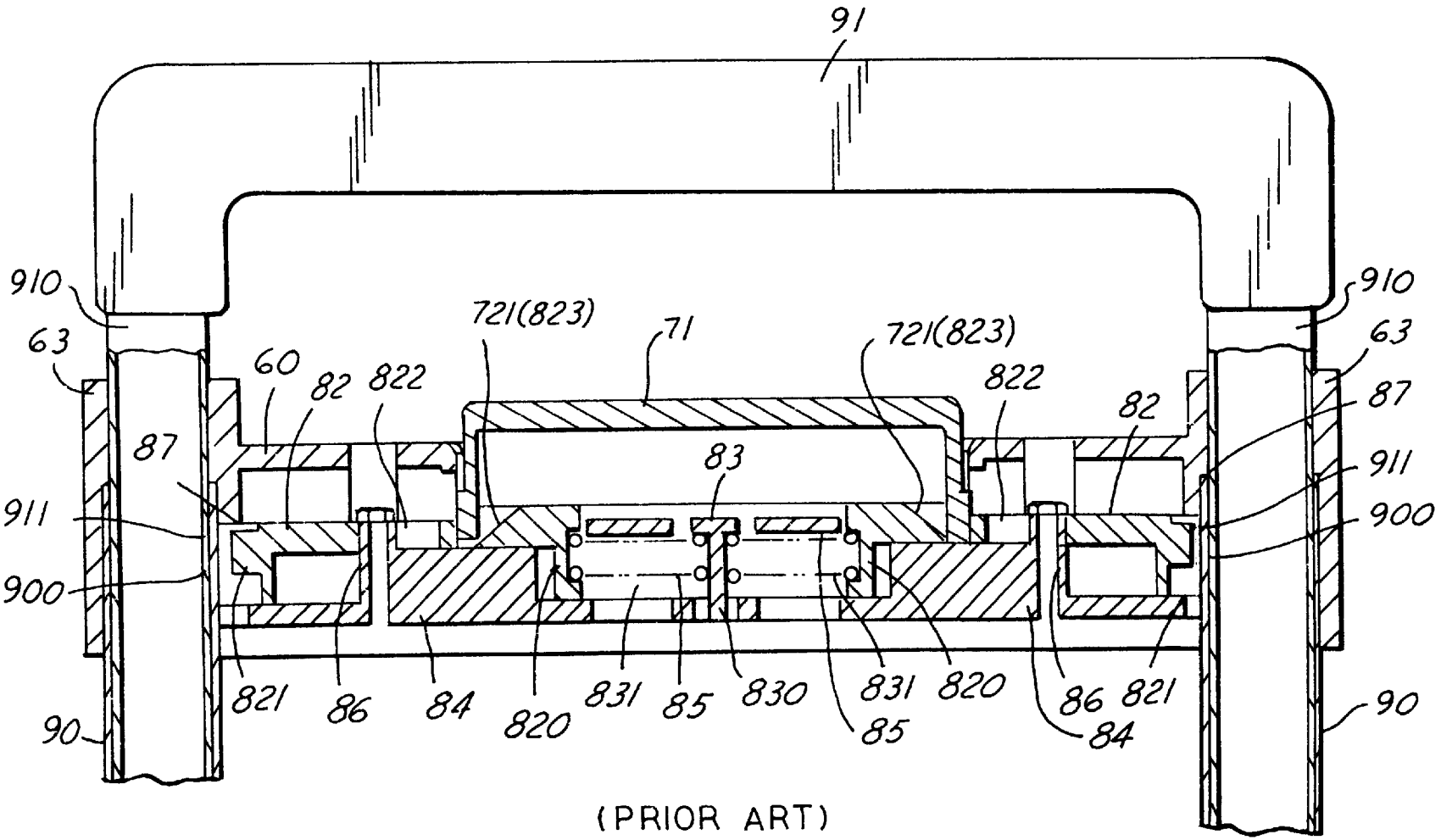
(PRIOR ART) FIG. 2
FIG. 2 shows the locking/unlocking mechanism of FIG. 1 when the knob thereof is pressed down to unlock the retractable handle.
Figure 3:
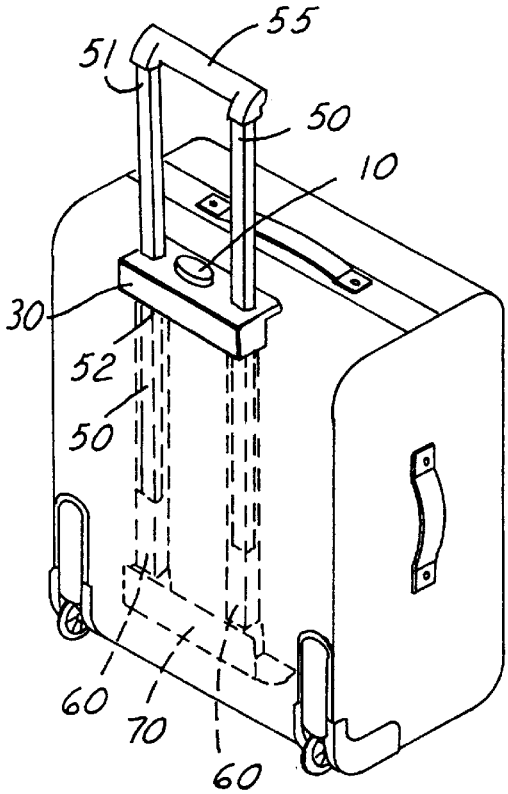
FIG. 3 is a schematic perspective view of a hand-trailable luggage case which is provided with the locking/unlocking mechanism of the invention for its extendable handle.

FIG. 3 is a schematic perspective view of a hand-trailable luggage case which is provided with the locking/unlocking mechanism of the invention. The locking/unlocking mechanism of the invention is specifically used to lock the extendable handle in retracted position on the hand-trailable luggage case and also allows the user to unlock the extendable handle so that the handle can be freely extended out for use by the user to drag the luggage case along the ground. As shown, the extendable handle includes a handle 55 and a pair of parallel elongated bars 50. When not in use, the elongated bars 50 are retracted into a pair of tubes 60. A casing 30 is sued to enclose and mount the locking/unlocking mechanism therein. A base support 70 is mounted near the bottom of the luggage case to support the two tubes 60 in position. One of the elongated bars 50 is formed with two stoppers including an upper stopper 51 provided near the handle 55 and a lower stopper 52 provided near the middle thereof. When released, the extendable handle can be freely extended out until the second stopper 52 is stopped by the casing 30. These constituent parts are substantially identical with the prior art.

The hand-trailable luggage case features the provision of the locking/unlocking mechanism of the invention to allow the user to conveniently release the extendable handle from retracted and locked position so that the extendable handle can be freely extended out. The locking/unlocking mechanism of the invention is mounted inside the casing 30. The button of an actuating device 10 is provided on top of the casing 30. The user can release the extendable handle from its retracted and locked position and then extend it out simply by pressing down on the button of the actuating device 10. Detailed structure of the locking/unlocking mechanism inside the casing 30 will be disclosed in the following with reference to FIGS. 4–6.

Figure 4:
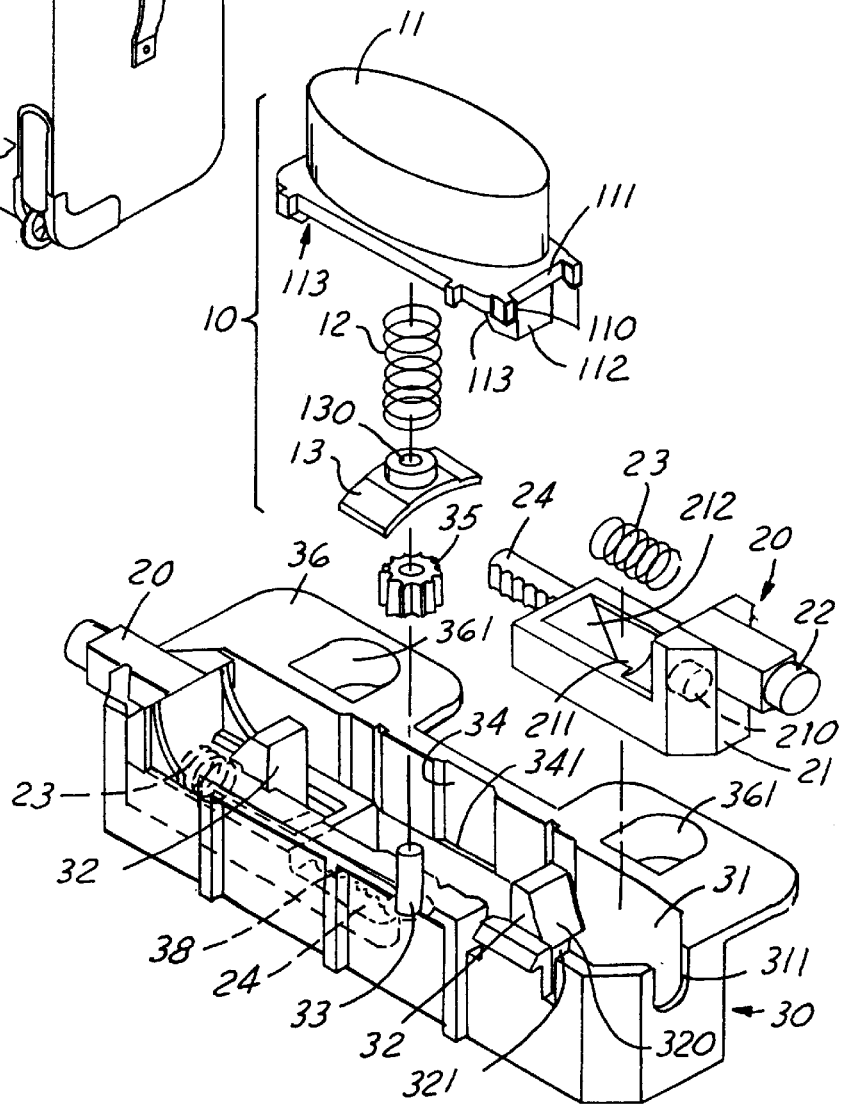
FIG. 4 is an exploded perspective view of the locking/unlocking mechanism of the invention.

Referring to FIG. 4, the locking/unlocking mechanism of the invention includes an actuating device 10, a casing 30 provided on a mounting board 40, and two slidable devices 20 mounted in the casing 30. The casing 30 is formed with a receptacle 31 and ear-like portions 36 each being formed with a recessed portion 361 that allows the casing 30 to be fastened to the mounting board 40 by means of bolt-and-nut means (not shown). A cutaway portion 311 is formed on each side of the receptacle 31, which allows the locking bolts 22 on the slidable devices 20 to pass therethrough. A post 33 is mounted in the base of the receptacle 31 of the casing 30. A gear 35 is axially mounted on the post 33. A pair of positioning pieces 32 are provided on both sides of the post 33. A space 38 is left between the two positioning pieces 32. Each of the positioning pieces 32 is formed with an inclined surface 320 and a stopper surface 321. A pair of guide slots 34 are formed oppositely on the inner walls of the receptacle 31, each being formed with a stopper surface 341 near the bottom.

Figure 7:
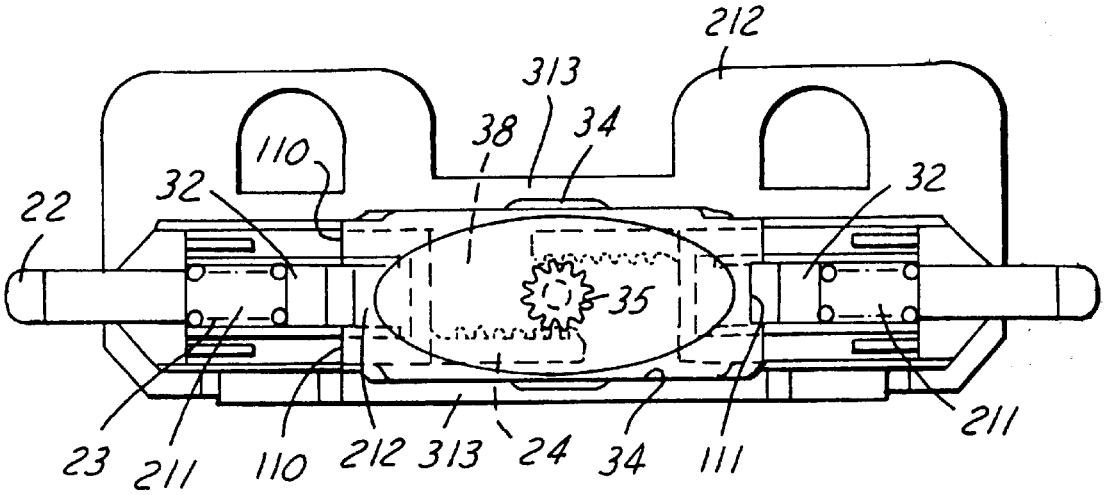
FIG. 7 is a schematic top view of a first preferred embodiment of the guide structures for the button on the locking/unlocking mechanism of the invention.

The actuating device 10 includes a button 11, a restoring spring 12, and an urging piece 13. The button 11 is formed with a pair of guide pieces 110 on one side. Between the guide pieces 110 is there formed with a guide slot 111. As shown in FIGS. 4 and 7, the button 11 can be set to be slidably movable up and down along the vertical sides of the positioning pieces 32. A guide block 112 is provided on the bottom of the button 11. The guide block 112 is formed with an inclined surface 113 on its inner side. The spring 12 has one end affixed to the bottom of the button 11 and the other end affixed to a protruded circular portion of the urging piece 13. A mounting hole 130 is formed in the protruded circular portion of the urging piece 13, which allows the urging piece 13 to be axially mounted on the post 33. The urging piece 13 is mounted in position in the receptacle 31, with tow sides thereof being inset in the two guide slots 34 and being supported on the stopper surface 341. The slidable devices 20 are each a slid body formed with an inclined surface 212 and a rectangular through opening 211 (see FIGS. 4, 7 and 8) in the center. The size of the solid body of the slidable devices 20 is suitably dimensioned such that the slidable devices 20 can be slidably movable within the receptacle 31. Further, the slidable devices 20 are each formed with a locking bolt 22 on the outer side near the top and a toothed bar 24 on the inner side. A protruded portion 210 is provided on the inside of each slidable device 20, which is used to mount a spring 23 in position thereon. The inclined surface 212 on each slidable device 20 is abutted on one inclined surface 113 of the guide block 112 on the bottom of the button 11. To mount the slidable devices 20 in the receptacle 31 of the casing 30, the inner ends of the rectangular through opening 211, i.e., the bottom of the inclined surface 212 is abutted on the inner side of the positioning pieces 32 in the receptacle 31 of the casing 30; and then the spring 23 is mounted between the stopper surface 321 of the positioning pieces 32 and the protruded portion 210 of the rectangular through opening 211. The locking bolt 22 of each slidable device 20 is set to be normally protruded to the outside of the casing 30 into a hole formed in the elongated bars of the extendable handle so that it can lock the extendable handle when in retracted position. Further, the toothed bar 24 is meshed to the gear 35 which is axially mounted on the post 33.

Figure 5:
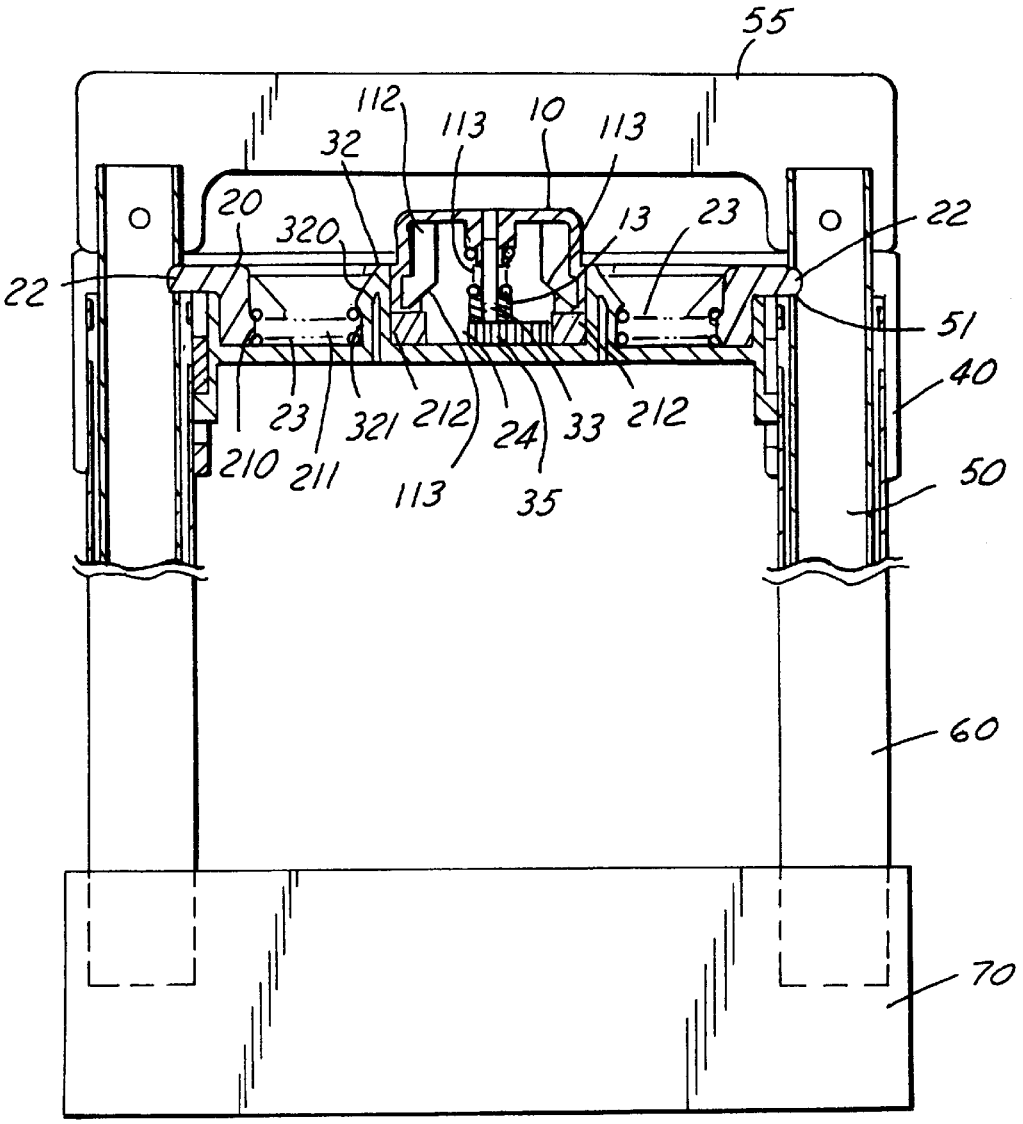
FIG. 5 is a schematic side view of the locking/unlocking mechanism of the invention when the elongated bars of the extendable handle are locked by the locking/unlocking mechanism.
Figure 6:
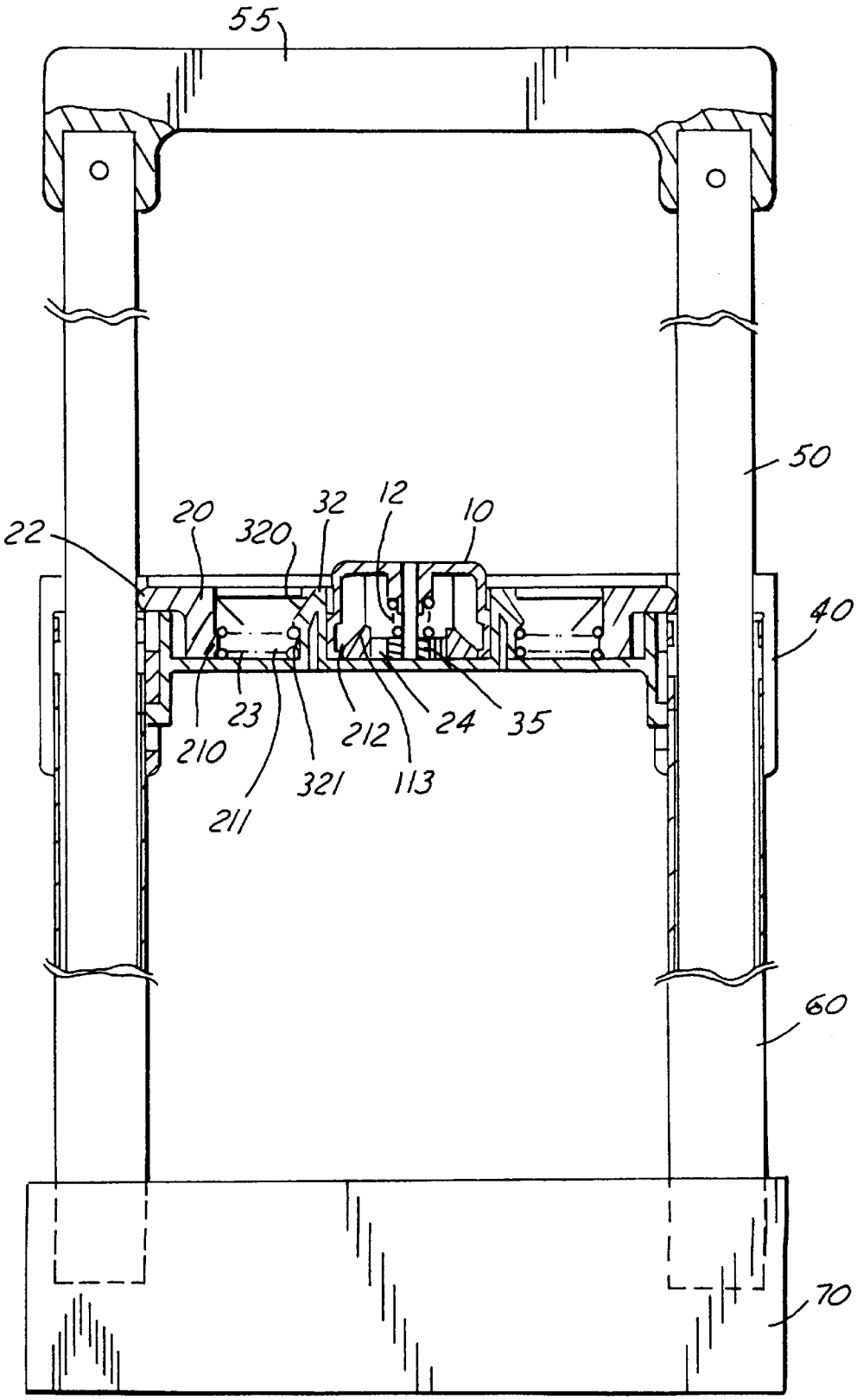
FIG. 6 is a schematic side view of the locking/unlocking mechanism of the invention when the elongated bars of the extendable handle are released from the locked state in the retracted position.

FIGS. 5 and 6 are used to depict the operation of the locking/unlocking mechanism of the invention, wherein FIG. 5 shows the locking/unlocking mechanism when the extendable handle is not in use and retracted and locked in position therein, and FIG. 6 shows when the extendable handle is released from the retracted and locked position. In the condition of FIG. 5, the button 11 is unpressed and thus at a high position. The locking bolt 22 of each of the two slidable devices 20 is under the elastic force from the spring 23 to thereby be positioned at the upper stopper 51 on each elongated bar 50, allowing the handle 55 to be hidden in the recess of the mounting board 40.

Further, as shown in FIG. 6, when the user wishes to extend out the extendable handle so as to use it to drag the luggage case along the ground, he/she needs just to press down the button 11 of the actuating device 10, causing the guide blocks 112 on the bottom of the button 11 to move downwards into the receptacle 31 of the casing 30. When the inclined surfaces 113 of the guide blocks 112 come in touch with the inclined surfaces 212 on the rectangular through opening 211 of the slidable devices 20, they will urge the two slidable devices 20 to move inwards toward each other. During this operation, the provision of the toothed bars 24 and the meshed gear 35 on the post 33 allows the movement of the slidable devices 20 toward each other to be very smooth and easy, which is a characteristic feature of the invention over the prior art.

Figure 8:
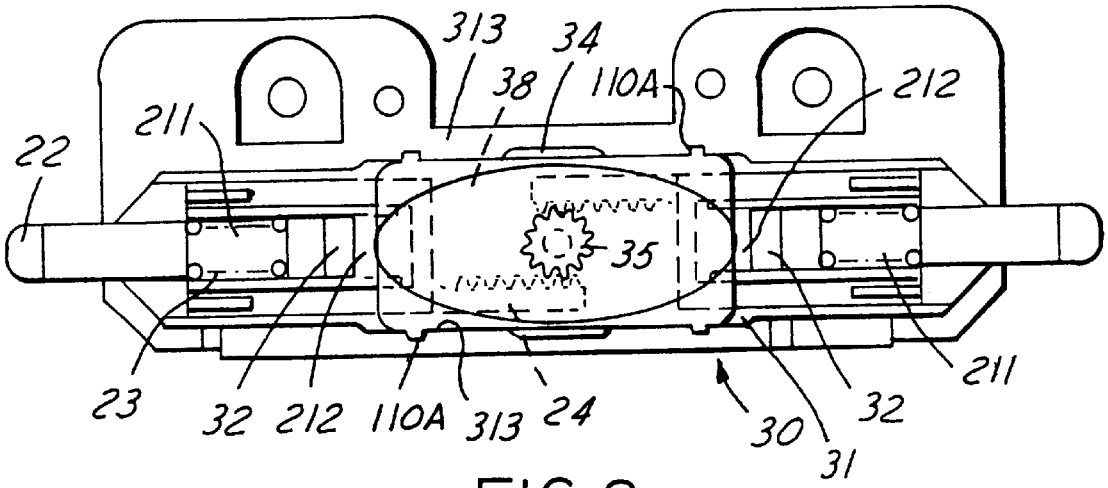
FIG. 8 is a schematic top view of a second preferred embodiment of the guide structures for the button on the locking/unlocking mechanism of the invention.

It is to be noted that the springs 23 associated with the slidable devices 20 are not necessarily to be mounted in the rectangular through opening 211. They can also be mounted elsewhere. The purpose of the springs 23 is simply to allow the slidable devices 20 to be restored to the original positions after the user releases his/her hand from the button 11 of the actuating device 10. Alternatively, the springs 23 can be mounted on the locking bolt 22 or various other suitable positions between the two slidable devices 20. Moreover, the positioning pieces 32 are not essential constituent elements of the invention. As shown in FIG. 8, the guide slots 3130 in the actuating device 10 can be instead formed in the inner walls 313 of the receptacle 31 (i.e., at the same positions as the guide slots 34). Correspondingly, a pair of guide pins 110A can be provided on the bottom of the actuating device 10. Various other modifications are possible.

In conclusion, the invention provides a locking/unlocking mechanism for hand-trailable luggage case which is characterized in the provision of the inclined surfaces 113 on the bottom of the button 11 of the actuating device 10 and the provision of the gear 35 meshed to the toothed bars 24 on the slidable devices 20. This allows the locking bolts 22 on the slidable devices 20 to be withdrawn when the button 11 of the actuating device 10 is pressed down by the user, thus allowing the locking/unlocking mechanism to operate smoothly. The invention is therefore more advantageous than the prior art.

The invention has been described using exemplary preferred embodiments. However, it is to be understood that the scope of the invention is not limited to the disclosed embodiments. On the contrary, it is intended to cover various modifications and similar arrangements. The scope of the claims, therefore, should be accorded the broadest interpretation so as to encompass all such modifications and similar arrangements.

What is claimed is:

1. A locking/unlocking mechanism for an extendable handle on a hand-trailable luggage case for the purpose of locking the extendable handle at a retracted position and allowing a user to unlock the extendable handle from the retracted and locked position so that the extendable handle can be freely extended out for use by the user, said extendable handle including a pair of parallel elongated bars which are extendable from and retractable into the luggage case, said locking/unlocking mechanism comprising:

an actuating device allowing the user to unlock and release the extendable handle from the retracted position by pressing thereon, said actuating device including a button, a restoring spring beneath said button, and two inclined surfaces;

a pair of slidable devices, each being formed with a locking bolt on an outer side thereof for locking the elongated bars of the extendable handle at the retracted position, an inclined surface which comes in abutment with and urged by the inclined surface on said actuating device when said button is pressed down, a toothed bar on an inner side thereof; and a restoring spring which allows said slidable devices to be restored to original position when said button is released; and a gear meshed to each toothed bar on each of said slidable devices, each toothed bar being moved along on said gear when said slidable devices are being moved inwards toward each other due to the depression of said button on said actuating device or outwards from each other due to the user releasing said button from the depressed state that causes said button to be restored up to original position by means of the restoring spring.

2. The locking/unlocking mechanism of claim 1, wherein the inclined surface on said button is matched in shape to the inclined surface on each of said slidable devices.

3. The locking/unlocking mechanism of claim 1, further comprising a pair of positioning pieces for respectively mounting said slidable devices thereon, each of said slidable devices being formed with a rectangular through opening in which each of said positioning pieces is positioned when mounting said slidable devices thereon, said opening being larger in dimension than each positioning piece, allowing said slidable devices to be movable therewithin and stopped by the inner walls of said rectangular through opening thereof.

4. The locking/unlocking mechanism of claim 1, further comprising a pair of guide pieces on one side of said button between which a guide slot is formed, which allow the button to be slidably movable along the positioning pieces.

5. The locking/unlocking mechanism of claim 1, wherein said button is formed with a guide protrusion which cooperates with the guide slots formed in inner walls of a said receptacle for enclosing said locking/unlocking mechanism to allow said button to be slidably movable therealong.

6. The locking/unlocking mechanism of claim 1, further comprising an urging piece which is mounted on said gear and affixed to the restoring spring of said button, allowing said urging piece to urge against said gear and said toothed bars for smooth movement of said toothed bars on said gear when said button is pressed down.

* * * * *